United States Patent [19]

Taga

[11] Patent Number: 4,628,842

[45] Date of Patent: Dec. 16, 1986

[54] DEVICE FOR PREVENTING FALL OF BUTTON PARTS FROM A CHUTE

[75] Inventor: Yukio Taga, Uozu, Japan

[73] Assignee: Yoshida Kogyo K.K., Tokyo, Japan

[21] Appl. No.: 841,313

[22] Filed: Mar. 19, 1986

[30] Foreign Application Priority Data

Mar. 19, 1985 [JP] Japan ..... 60-39371[U]

[51] Int. Cl.[4] ..... D05B 3/22

[52] U.S. Cl. ..... 112/113

[58] Field of Search ..... 112/113, 110, 115, 104, 112/106; 221/268, 276, 271

[56] References Cited

U.S. PATENT DOCUMENTS

| | | | |
|---|---|---|---|
| 3,363,592 | 1/1968 | Medoff | 112/113 |
| 3,712,253 | 1/1973 | Asnes | 112/113 |
| 3,837,530 | 9/1974 | Snyder | 112/113 X |
| 4,436,041 | 3/1984 | Taddicken | 112/110 |
| 4,445,448 | 5/1984 | Fletcher | 112/110 |

*Primary Examiner*—H. Hampton Hunter

*Attorney, Agent, or Firm*—Hill, Van Santen, Steadman & Simpson

[57] ABSTRACT

A button attaching machine has a chute assembly for conveying button parts and a blocking device for preventing button parts from falling from a detachable intermediate chute of the chute assembly when the intermediate chute is detached. The blocking device comprises a spring-loaded plunger supported by the intermediate chute adjacent to a lower end thereof and reciprocably movable in a plane perpendicular to the longitudinal axis of the intermediate chute. The plunger is normally held in engagement with a lower chute to retract away from a button-parts guide channel of the chute assembly, and upon detachment of the intermediate chute, it is movable into a blocking position where it is disposed below the channel and spaced from the lower end of the intermediate chute by a distance which is small enough to block the passage of the button parts.

6 Claims, 5 Drawing Figures

DEVICE FOR PREVENTING FALL OF BUTTON PARTS FROM A CHUTE

BACKGROUND OF THE INVENTION

1. Field of the Invention

The present invention relates to a button attaching machine having a chute assembly, and more particularly to a device incorporated in the machine for preventing button parts from falling from a detachable intermediate chute of the chute assembly when the intermediate chute is detached.

2. Prior Art

A known button attaching machine has a chute assembly for conveying button parts from a reservoir to a terminal guide leading to a button attaching station. The chute assembly includes an upper chute connected to the reservoir, a lower chute connected to the terminal guide, and an intermediate chute extending between and detachable from the upper and lower chutes. The intermediate chute normally defines jointly with the upper and lower chutes a combined, uninterrupted channel for receiving and transporting a succession of button parts. A primary problem associated with this type of machine is that the button parts are apt to fall out of the chutes when the intermediate chute is detached upon termination of the machine operation, which necessitates added labor to collect the pieces of button parts scattered over the floor.

SUMMARY OF THE INVENTION

It is therefore an object of the present invention to provide a device associated with a button attaching machine for preventing button parts from falling from an intermediate chute when the latter is detached from a chute assembly of the button attaching machine.

According to the invention, a button attaching machine has a chute assembly for conveying button parts and a blocking device for preventing button parts from falling from a detachable intermediate chute of the chute assembly when the intermediate chute is detached. The blocking device comprises a spring-loaded plunger supported by the intermediate chute adjacent to a lower end thereof and reciprocably movable in a plane perpendicular to the longitudinal axis of the intermediate chute. The plunger is normally held in engagement with a lower chute to retract away from a button-parts guide channel of the chute assembly, and upon detachment of the intermediate chute, it is movable into a blocking position where it is disposed below the channel and spaced from the lower end of the intermediate chute by a distance which is small enough to block the passage of the button parts.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
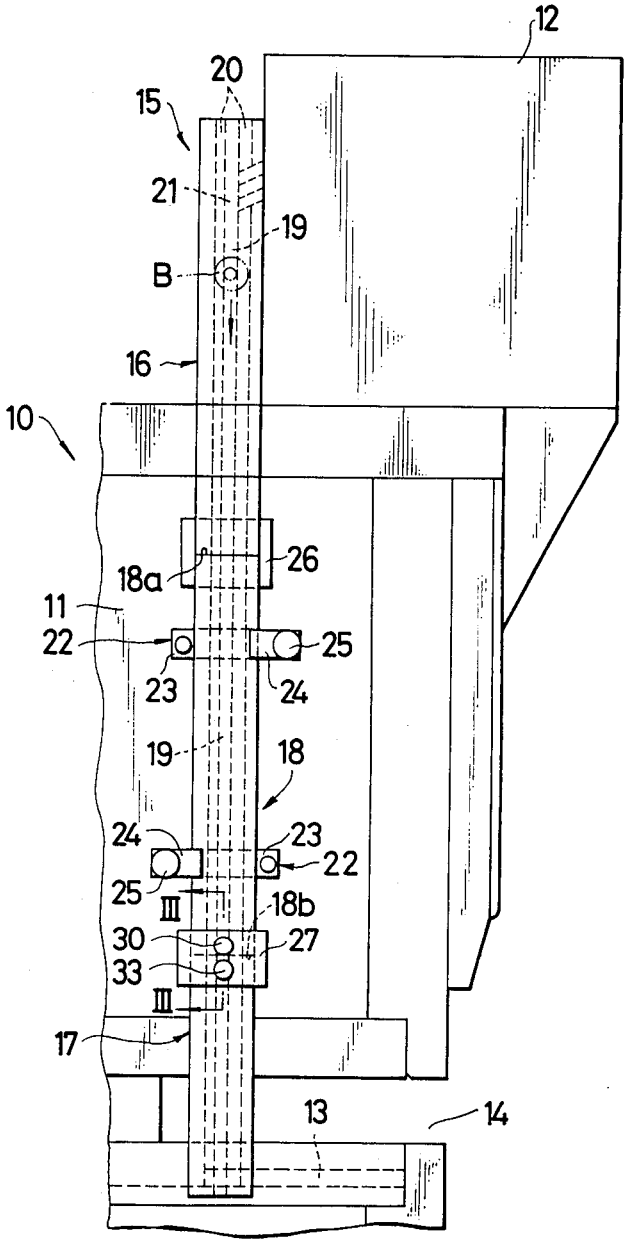
FIG. 1 is a fragmentary side elevational view of a button attaching machine having a blocking device embodying the present invention.

As shown in FIG. 1, a button attaching machine 10 has a support 11, a reservoir 12 mounted on an upper portion of the support 11 and containing a multiplicity of button parts B, a terminal guide 13 disposed at a lower portion of the support 11 and leading to a lower unit (not shown) of a button attaching station 14, and a chute assembly 15 for conveying the button parts B successively from the reservoir 12 to the terminal guide 13.

The chute assembly 15 includes an upper chute 16 connected to the recervoir 12, a lower chute 17 connected to the terminal guide 13, and an intermediate chute 18 extending between the upper and lower chutes 16, 17 so as to define jointly therewith a combined uninterrupted channel 19 for receiving and transporting the button parts B in a row. Each of the chutes 16, 17 and 18 has through its entire length a pair of confronting flanges 20, 20 defining therebetween a longitudinal aperture 21 communicating with the channel 19.

Figure 2:
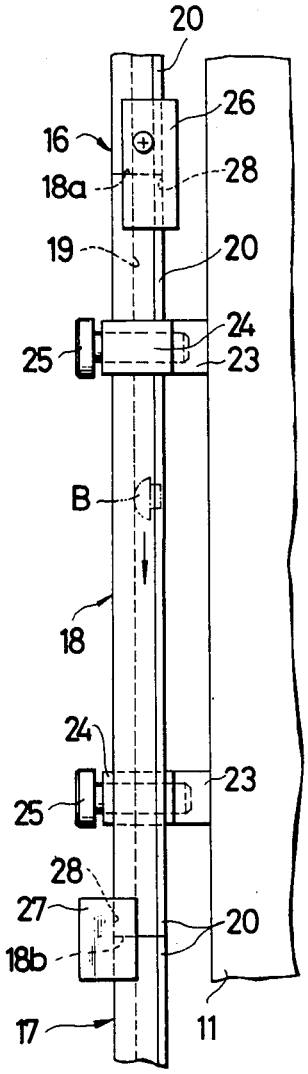
FIG. 2 is an enlarged fragmentary front elevational view of FIG. 1, showing a chute assembly of the button attaching machine.

As shown in FIG. 1, the intermediate chute 18 is detachably mounted on the support 11 by means of a pair of spaced retainers 22, 22 (FIG. 2), each including a first plate 23 secured to the support 11, a second plate 24 for clamping the intermediate chute 18 in cooperation with the first plate 23, and a screw 25 for fastening the second plate 24 to the first plate 23.

The upper end **18*a* of the intermediate chute 18 is releasably connected to the lower end of the upper chute 16 by means of a rectangular first chute holder 26 secured to the upper chute 16, and the lower end 18*b* of the intermediate chute 18 is releasably connected to the upper end of the lower chute 17 by means of a rectangular second chute holder 27 secured to the intermediate chute 18. Each chute holder 26, 27 has through its entire width a groove 28 (FIG. 2) for receiving the confronting ends of adjacent chutes 16, 18 and 17, 18**.

Detaching or removing the intermediate chute 18 from the machine 10 may be done by loosening the screws 25 and then rotating the second plates 24 through an angle of 90°, or alternatively simply removing the second plates 24.

Figure 3:
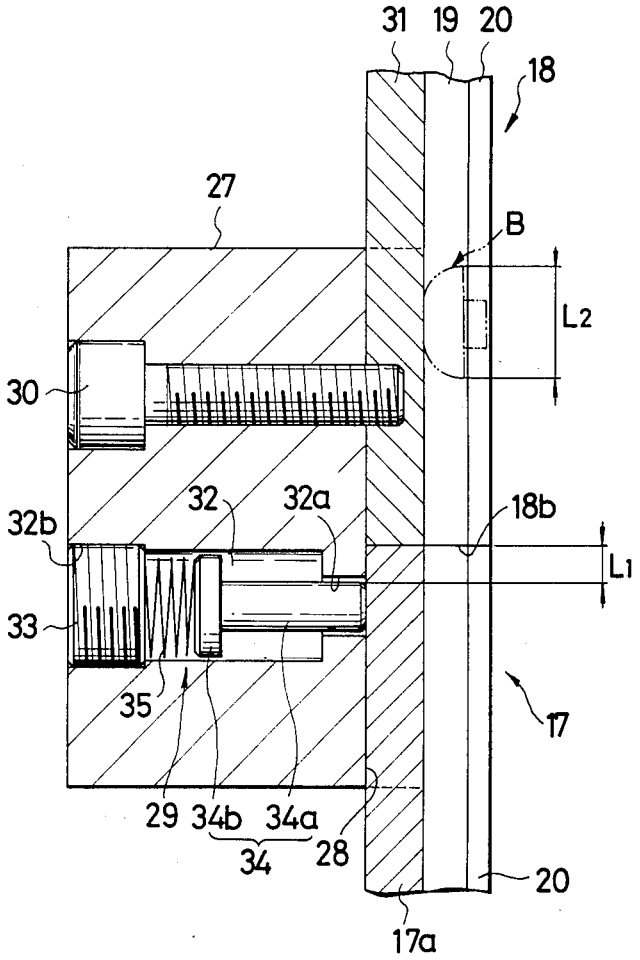
FIG. 3 is an enlarged cross-sectional view taken along line III—III of FIG. 1; showing the details of the blocking device.

As shown in FIG. 3, the machine 10 includes a blocking device 29 mounted in the second chute holder 27 for preventing the button parts B from falling from the intermediate chute 18 when the latter is removed. The chute holder 27 that carries the blocking device 29 is secured by a screw 30 to the bottom wall 31 of the intermediate chute 18 opposite to the confronting flanges 20, 20 and near the lower end **18*b* of the chute 18. The second chute holder 27 has an elongate cave or recess 32 extending in a plane perpendicular to the longitudinal axis of the intermediate chute 18 for retaining therein the blocking device 29. The recess 32 is open at one end through a reduced diameter portion 32*a* and closed at the other end 32***b* by an externally threaded screw 33.

Figure 4:
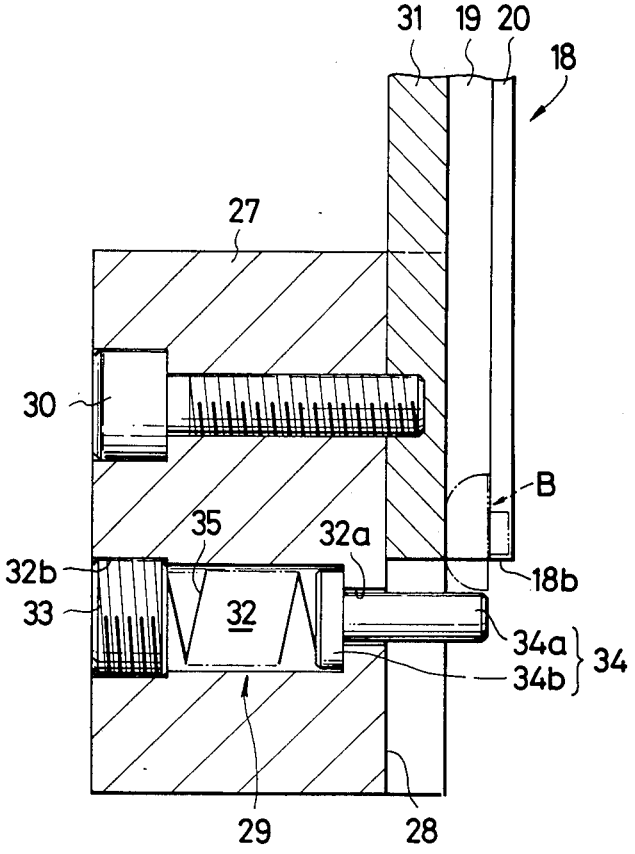
FIG. 4 is a view similar to FIG. 3 but showing the blocking device in working position.

The blocking device 29 includes a blocking member in the form of a plunger 34 movably received in the recess 32. The plunger 34 has a cylindrical body 34*a* of a diameter slightly smaller than that of the reduced diameter portion 32*a* so that the plunger body 34*a* can move therethrough, and an enlarged spring retainer head 34*b* joined with an inner end of the plunger body 34*a*. The blocking device 29 further includes a compression coil spring 35 interposed between the retainer head 34*b* and the screw 33 threaded into the opposite end 32*b* of recess 32. The plunger 34 is normally urged by the spring 35 toward the bottom wall 17*a* of the lower chute 17 to rest against it adjacent to the upper end thereof which abuts against the lower end 18*b* of the intermediate chute 18. The upper peripheral edge of the plunger body 34*a* is positioned slightly below and spaced apart from the lower end 18*b* of the intermediate chute 18 by a distance $L_1$ which is small enough to block the passage of the individual button parts B. In the illustrated embodiment, the button parts B have a circular shape of a maximum diameter $L_2$. The distance $L_1$ is smaller than the diameter $L_2$ of the button parts B so that when the intermediate chute 18 is released from the lower chute 17, the plunger 34 is forced by the spring 35 to move into a blocking position disposed below the channel 19 to prevent the button part B from falling from the intermediate chute 18, as shown in FIG. 4.

Upon completion of the machine operation or when otherwise it is desired to remove the intermediate chute 18, this can be done simply by disconnecting this chute 18 by hand from the lower chute 17 without the fear of letting the buttons B drop from the intermediate chute 18 onto the floor.

Reassembling the intermediate chute 18 can be done simply by holding the plunger 34 against the wall 17*a* of the lower chute 17 until it is retracted to the normal position of FIG. 3 against the force of the spring 35.

Figure 5:
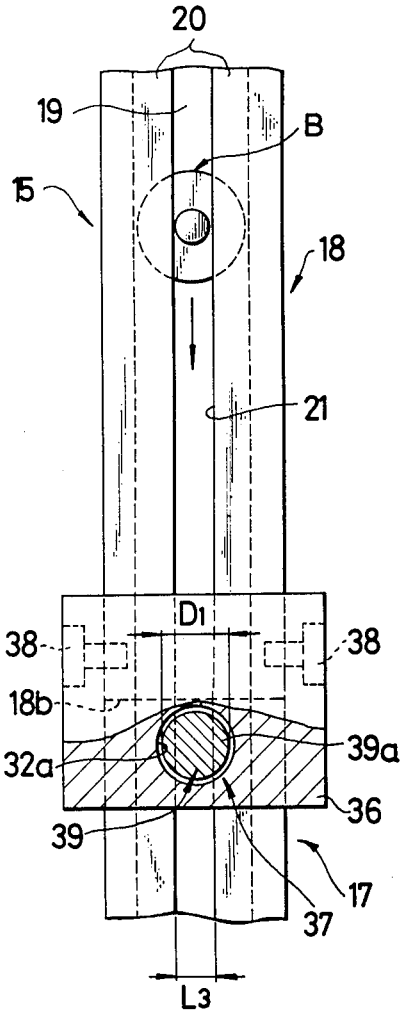
FIG. 5, appearing with FIG. 2, is an enlarged schematic view, partly in cross section, of a modified blocking device.

FIG. 5 shows a second embodiment of the invention in which the mounting position of a second chute holder 36 is reversed; that is, a blocking device 37 is mounted in the chute holder 36 such that it is positioned to face the channel 19 of the chute assembly 15. The second chute holder 36 is secured by a pair of screws 38, 38 to opposite sides of the intermediate chute 18 adjacent the lower end 18*b* thereof. The blocking device 37 is substantially the same in construction and operation as that of the first embodiment already described, except that a spring-loaded blocking member or plunger 39 has a cylindrical plunger body 39*a* having a diameter $D_1$ which is larger than the distance $L_3$ between the confronting flanges 20, 20, so that it can normally rest against these flanges 20, 20 of the lower chute 17 under the force of the spring (not shown) without slipping into the channel 19 through the aperture 21 to block the passage of button parts B.

Although various minor modifications may be suggested by those versed in the art, it should be understood that I wish to embody within the scope of the patent warranted hereon, all such embodiments as reasonably and properly come within the scope of my contribution to the art.

What is claimed is:

1. In a button attaching machine having a support, a reservoir mounted on an upper portion of said support for containing a multiplicity of button parts, a terminal guide mounted on a lower portion of said support, and a chute assembly for conveying the button parts successively from said reservoir to said terminal guide, said chute assembly including an upper chute connected to said reservoir, a lower chute connected to said terminal guide, and an intermediate chute detachably mounted on said support and extending between said upper and lower chutes so as to define jointly therewith a combined, uninterrupted channel for receiving and transporting the button parts in succession, each of said upper, lower and intermediate chutes having through its entire length a pair of confronting flanges defining therebetween a longitudinal aperture communicating with said channel, and a blocking device for preventing the button parts from falling from said intermediate chute when the latter is detached, said blocking device comprising:

(a) a blocking member adapted to be supported by said intermediate chute adjacent to a lower end thereof, said blocking member being reciprocaly movable in a plane perpendicular to the longitudinal axis of said intermediate chute, said blocking member being normally held in engagement with said lower chute to retract away from said channel and, upon detachment of said intermediate chute, being movable into a blocking position where it is disposed below said channel and spaced from said lower end of said intermediate chute by a distance which is small enough to block the passage of the button parts; and (b) resilient means acting on said blocking member 34; 39 for urging the latter toward said blocking position.

2. A blocking device according to claim 1, said blocking member, when retracted, resting against a side of said lower chute which is opposite to said flanges.

3. A blocking device according to claim 1, said blocking member, when retracted, resting against said flanges.

4. A blocking device according to claim 1, including a chute holder for connecting said lower end of said intermediate chute and an upper end of said lower chute, said chute holder including a recess having an open end normally facing said lower chute, the opposite end of said recess being closed, said blocking member comprising a plunger reciprocably disposed in said recess and projectable therefrom through said open end, said resilient means comprising a compression coil spring disposed in said recess and acting between said closed other end of said recess and said plunger.

5. A blocking device according to claim 4, said open end of said recess normally facing a side of said lower chute which is opposite to said flanges so that said plunger rests against said side of said lower chute.

6. A blocking device according to claim 4, said open end of said recess communicating with said channel through said aperture, said plunger having a diameter larger than the distance between said confronting flanges.

* * * * *